United States Patent [19]

Wasserman et al.

[11] 4,262,480

[45] Apr. 21, 1981

[54] NOVELTY YARN AND METHOD AND APPARATUS OF MAKING SAME

[75] Inventors: Allan Wasserman, 29 Kennedy Blvd., Lincoln, R.I. 02865; Frederick A. Lowenstein, 66 Park Ave., New York, N.Y. 10016

[73] Assignees: Frederick A. Lowenstein, New York, N.Y.; Ronnee M. Wasserman; Allan Wasserman, both of Lincoln, R.I.

[21] Appl. No.: 17,913

[22] Filed: Mar. 1, 1979

[51] Int. Cl.[3] ..... D02G 3/02

[52] U.S. Cl. ..... 57/227; 57/16; 57/228; 428/377; 428/379

[58] Field of Search ..... 428/375, 379, 364, 373, 428/374, 392, 377; 57/212, 210, 16–18, 227, 228, 207

[56] References Cited

U.S. PATENT DOCUMENTS

| | | | |
|---|---|---|---|
| 1,203,896 | 11/1916 | Morris | 428/375 X |
| 1,574,004 | 2/1926 | Ryder | 57/210 |
| 2,053,411 | 9/1936 | Zarafu | 57/16 |
| 2,342,098 | 2/1944 | Alderfer | 428/365 X |
| 2,687,673 | 8/1954 | Boone | 57/210 X |
| 3,243,338 | 3/1966 | Jackson | 428/373 X |
| 3,301,017 | 1/1967 | Bird et al. | 57/210 |
| 3,382,655 | 5/1968 | Wasserman | 57/16 |
| 3,490,224 | 1/1970 | Bourgeas | 57/210 |

*Primary Examiner*—Lorraine T. Kendell
*Attorney, Agent, or Firm*—Salter & Michaelson

[57] ABSTRACT

A decorative composite novelty yarn which has use as a craft item as in making floral decorations. The composite yarn includes a core including a deformable wire strand and a plurality of textured core yarns generally in aligned contact with each other and said wire strand. A first frieze yarn is wrapped in one direction about the core and a second frieze yarn is thereafter wrapped about the core and the first frieze yarn in the opposite direction. The novelty yarn is formed on a modified spinning frame having vertically spaced spindles for rotationally wrapping the frieze cover yarns and drive means for positively feeding the wire strand.

5 Claims, 3 Drawing Figures

NOVELTY YARN AND METHOD AND APPARATUS OF MAKING SAME

BACKGROUND AND SUMMARY OF THE INVENTION

This invention relates to a novelty yarn and the method and apparatus for forming such yarn. Various decorative and composite novelty yarns are known but do not fulfill the desirable plural objectives of the present invention including the use of such yarn in making ornamental decorations such as artificial flowers, for general craft usage and for securing articles such as gift wrap. A desirable feature of certain craft yarns is that they may be formed as by bending to various stable configurations such that ornamental structures may be formed thereby, i.e. artificial flowers and the like. In order to secure the necessary formability and shape retention, it has been proposed to utilize a bendable wire core suitably wrapped with decorative cover yarns, however a tendency of constructions of this type is for the cover yarns to longitudinally slip in relationship to the wire core and thus form an unsuitable overall decorative yarn construction.

Patents of general interest include U.S. Pat. Nos. 2,503,237 and 3,382,655; the citation of which constitutes applicant's Prior Art Statement.

It is accordingly a primary object of the present invention to produce a decorative novelty yarn of the aforementioned type which utilizes a wire strand but which avoids undesirable slippage between such wire strand and decorative overwrapped yarns.

A further object of the present invention is the provision of a novel apparatus and method for forming the aforementioned decorative composite yarn construction.

These and other objects of the present invention are accomplished by the provision of a decorative yarn which includes a core formed from a thin formable wire strand and a plurality of generally parallel aligned and contacting textured synthetic fiber core yarns, which core is thereafter spirally overwrapped in one direction by at least two separate first decorative yarns and thereafter in the other direction by at least two separate second decorative yarns so as to lock the core and the first cover yarns in place to insure complete decorative cover of the core including the wire strand. The decorative yarns are wrapped about the core in the aforementioned opposite directions through the use of a modified construction spinning frame in which the wire strands are positively driven through the wrapping stations and wherein the composite yarn formed by such process and apparatus is taken up at the same rate of speed. The textured core yarns act as a partial cover for the wire strand and by intertwining and/or other relative contact therewith prevent slippage between the overwrapped decorative yarns and the wire strand in part forming the core of the decorative composite yarn produced.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 3:
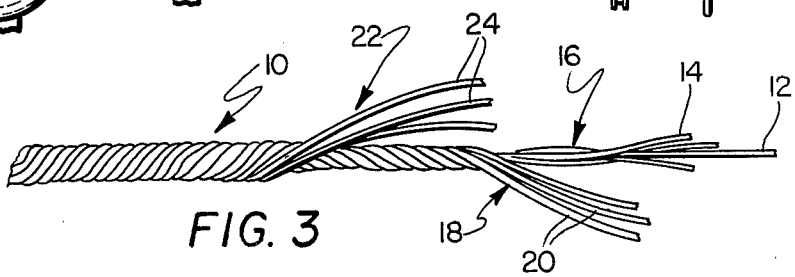
FIG. 3 is a partially unwrapped view of the resultant composite yarn showing a preferred structure thereof.

Turning now to the drawing and particularly FIG. 3 thereof, the overall structure of the decorative composite yarn 10 of the present invention is best shown. Therein a single wire strand 12 is intertwined, intermixed or otherwise laid generally parallel with a plurality of textured synthetic fiber core yarns 14 so as to form a composite core 16. The wire 12 is a steel copper-coated wire of about 0.014 inches in diameter and is accordingly relatively stiff yet formable as by bending into shape retentive forms. Other wires having the same general functional characteristics may be utilized.

The core yarns 14 are textured by any known available process; however, particularly desirable textured yarn which may be utilized as the core yarns 14 is that textured frieze yarn described in U.S. Pat. No. 3,382,655 issued May 14, 1968 to one of the co-inventors of the present invention. Such decorative frizette or frieze yarn is formed by wrapping a core yarn of non-metallic material such as rayon and the like with a selected metallic yarn in one direction and thereafter locking the metallic yarn in place by a cover yarn of a non-metallic material such as rayon, polyester or the like wrapped in the opposite direction. Generally a selected metallic yarn in widths ranging from one one hundredth inch (0.01") to about one thirty second (1/32") inch is utilized. In this particular regard as well as for the general content thereof, the disclosure of the aforementioned Wasserman patent, U.S. Pat. No. 3,382,655, is hereby specifically incorporated by reference into the subject specification.

A plurality and preferably at least four such textured core yarns 14 are utilized in conjunction with the wire core strand 12 in order to form the composite core 16. In that regard it should be pointed out that the core yarns 14 are disposed generally parallel to and in adjacent contact with the wire strand 12 and are preferably to some extent intertwined therewith so as to form a relatively high friction engagement therewith and so as to at least partially cover the wire 12. The composite core 16 is thereafter wrapped with a cover 18 formed from at least two decorative cover yarns 20, the cover 18 being spirally wrapped in a first direction. Thereafter a second cover 22 formed from at least two decorative yarns 24 is spirally wrapped in the opposite direction about the first cover 18 so as to in effect lock the first cover 18 in place and finalize the decorative composite yarn 10 of the present invention.

The yarns 20 and 24 may be decorative in regard to their texture or color characteristics. The term "color characteristic" as used herein refers to the characteristic of the yarn or its constituent fibers which results in a difference in the color appearance of the yarn as when such difference comes from a different color, light reflectivity, dye affinity or the like. A particularly desirable decorative yarn that may be utilized for the yarn 20 and/or 24 making up the first and second covers 18 and 22 respectively may be those decorative frizette (frieze) yarns described in the aforementioned Wasserman patent. Additionally, the decorative effect achieved by the first cover 18 may vary from that achieved by the second cover 22 or by the individual effects contributed thereto by the component yarns 20 and 24 respectively thereof.

The net result of the decorative composite yarn 10 having the structure as above indicated is one which may be used in a variety of manners in accordance with the objects of the present invention, including a craft yarn which may be formed by bending into decorative effects so as to product simulated flowers and the like as well as for decorative wrapping purposes. In that regard it is believed that the plurality of textured core yarns not only give bulk, cover and overall texture to the composite yarn 10 but further prevent the wrapped cover yarns 20 and 24 from slipping across the surface of the core strand 12 as with prior art construction.

Figure 1:
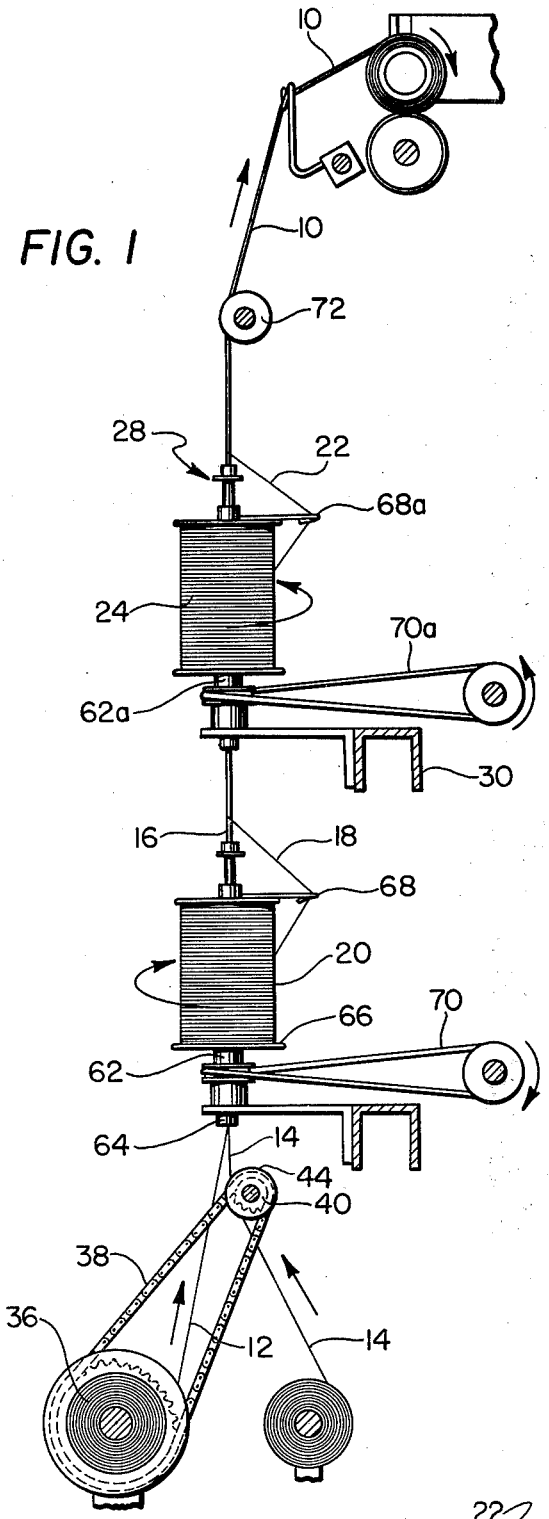
FIG. 1 is a side elevational view in somewhat schematic form of apparatus utilized to form the decorative composite yarn of the present invention.
Figure 2:
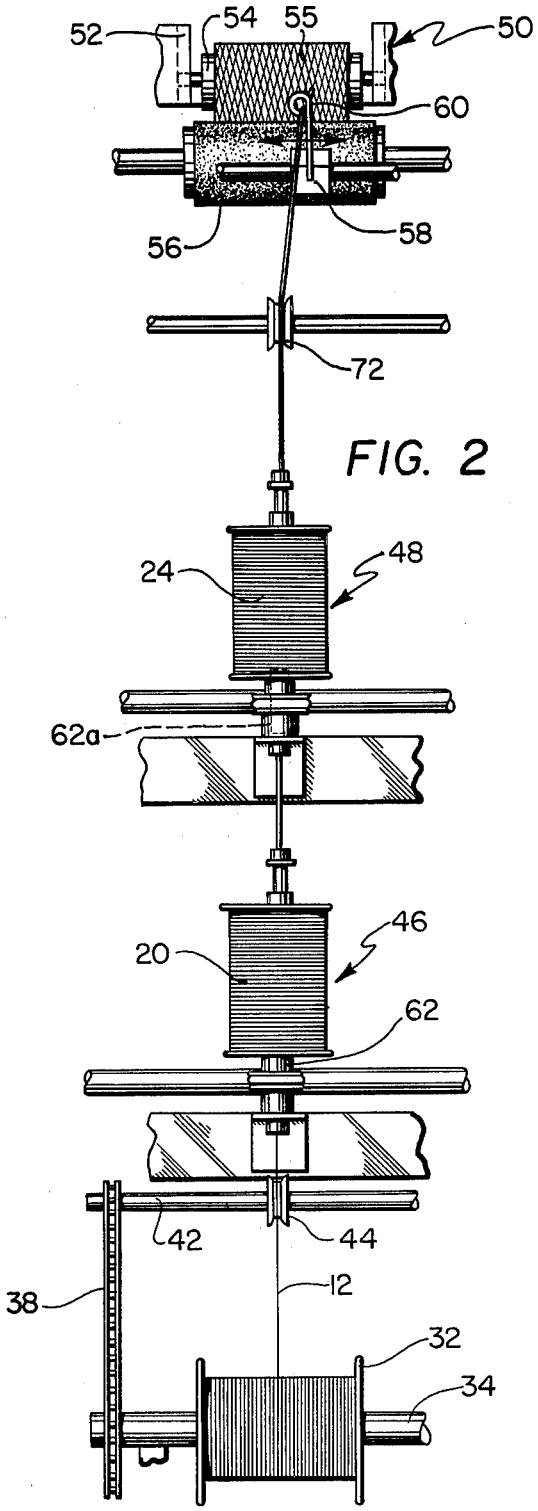
FIG. 2 is a front elevational view thereof.

Turning now to FIGS. 1 and 2 of the drawing, the apparatus and method through which the novel composite decorative yarn 10 of the present invention is formed is illustrated. Both such figures show a single station of a multiple modified construction spinning frame 30 wherein the decorative composite yarn of the present invention may be formed in an upward stepwise progression. Therein a supply of wire strand 12 is supported on a creel 32 in turn supported on a shaft 34. One end of the shaft 34 includes a sprocket 36 which is driven by a chain 38 in turn connected to a drive sprocket 40 mounted on a drive shaft 42. The drive shaft 42 additionally includes a guide roller 44 for contacting a plurality of core yarns 14 as they are upwardly drawn into a first wrapping station 46, then to a second wrapping station 48 and thereafter to a take-up station 50.

The take-up station 50 includes support means 52 for supporting an empty wind-up core 54 on which the completed composite yarn 10 is wound as well as drive means including a cylinder 56 having a frictional surface for contacting the partially completed package 55 so as to rotate the same. A traversing mechanism 58 including a guide 60 is included so as to traverse the completed composite yarn back and forth across the face of the partially completed package 55. In this manner, the composite yarn 10 is drawn upwardly through the wrapping stations 46 and 48. In addition, the wire strand 12 is positively fed upwardly through the such wrapping stations by the positive drive of its supply roll 32. Additionally, the speed at which the wire is upwardly fed and the composite yarn 10 removed as by the take-off assembly 50 is coordinated at approximately the same linear rate.

The first wrapping station 46 includes a tubular spindle 62 having a hollow entrance portion 64 into which the wire strand 12 and the plurality of textured core yarns 14 progressively converge for alignment in generally intertwined parallel relationship to each other. The spindle 62 further includes a spool 66 on which a supply of decorative yarn 20 is wrapped in such a fashion that at least two yarn ends 20 move simultaneously through a rotating flyer 68 of known construction such that the first cover 18 is spirally wound around the composite core 16 as it emerges from the upper end of the first spindle 62. A drive mechanism 70 of known construction is utilized to rotate the flyer 68 in a first rotational direction.

The construction of the second wrap station 48 is similar to the first wrap station 46, however, the drive means **70*a* thereof is structured so as to rotate the flyer 68*a* thereof in the opposite rotational direction so that a plurality of yarns 24 forming the second cover 22 are laid down in the opposite direction on the partially completed composite yarn as it emerges from the top of the spindle 62*a*. The fully wrapped composite yarn thereafter passes over a tension roller 72 and then to the take-up mechanism 50** as previously explained.

It may be accordingly seen that in addition to the novel composite yarn construction 10 disclosed by the present invention that a novel apparatus and unique manner of forming such yarn is disclosed as well.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A bendable, shape-retentive decorative composite novelty yarn comprising:

(a) a core consisting of a single solitary uncoated wire strand that is readily bendable but that retains its shape when bent, and a plurality of textured synthetic core yarns disposed non-adhesively about said wire strand so as to substantially cover same, said core yarns extending substantially longitudinally of said wire strand;

(b) a plurality of first decorative cover yarns spirally wrapped about said core in one direction; and (c) a plurality of second decorative cover yarns spirally wrapped about said core and said first cover yarns in the opposite direction, said first and second cover yarns being prevented from slipping axially with respect to said core because of the frictional engagement of said first cover yarns with said texturized core yarns.

2. The yarn of claim 1, said core yarns being a synthetic fiber frieze yarn.

3. The yarn of claim 1, said first and second cover yarns each being a synthetic fiber frieze yarn.

4. The yarn of claim 2, said first and second cover yarns being a synthetic fiber frieze yarn.

5. The yarn of claim 1 further characterized in that said core comprises four textured core yarns.

* * * * *